US009579701B2

(12) United States Patent
Kubota et al.

(10) Patent No.: US 9,579,701 B2
(45) Date of Patent: Feb. 28, 2017

(54) MANUFACTURING METHOD OF NON-ORIENTED ELECTRICAL STEEL SHEET

(75) Inventors: Takeshi Kubota, Tokyo (JP); Masahiro Fujikura, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 182 days.

(21) Appl. No.: 13/813,862

(22) PCT Filed: Jul. 29, 2011

(86) PCT No.: PCT/JP2011/067409
§ 371 (c)(1),
(2), (4) Date: Feb. 1, 2013

(87) PCT Pub. No.: WO2012/017933
PCT Pub. Date: Feb. 9, 2012

(65) Prior Publication Data

US 2013/0125601 A1 May 23, 2013

(30) Foreign Application Priority Data

Aug. 4, 2010 (JP) ..... 2010-175580

(51) Int. Cl.

| | |
|---|---|
| ***B21B 15/00*** | (2006.01) |
| ***C21D 8/12*** | (2006.01) |
| ***C21D 6/00*** | (2006.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/16*** | (2006.01) |
| ***C22C 38/18*** | (2006.01) |
| ***C22C 38/34*** | (2006.01) |
| ***H01F 1/16*** | (2006.01) |
| ***C22C 38/02*** | (2006.01) |

(52) U.S. Cl.
CPC ..... *B21B 15/00* (2013.01); *C21D 8/1222* (2013.01); *C21D 8/1233* (2013.01); *C21D 8/1266* (2013.01); *C21D 8/1272* (2013.01); *C21D 9/46* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/16* (2013.01); *C22C 38/18* (2013.01); *C22C 38/34* (2013.01); *H01F 1/16* (2013.01); *C21D 6/008* (2013.01); *C21D 2201/05* (2013.01)

(58) Field of Classification Search
CPC ..... C21D 8/12; C21D 8/1233; C21D 8/1266; C21D 8/1283; C21D 8/1255; C21D 6/008; H01F 1/16
USPC ..... 72/200
See application file for complete search history.

(56) References Cited

U.S. PATENT DOCUMENTS

| | | | | |
|---|---|---|---|---|
| 3,203,839 | A * | 8/1965 | Takahashi | C21D 8/1233 148/110 |
| 4,046,602 | A * | 9/1977 | Stanley | C21D 8/12 148/111 |
| 4,293,336 | A * | 10/1981 | Matsumura | H01F 1/147 420/103 |
| 4,898,627 | A * | 2/1990 | Schoen | C21D 1/26 148/111 |
| 2006/0243351 | A1* | 11/2006 | Ohashi et al. | 148/112 |
| 2009/0202383 | A1* | 8/2009 | Tanaka et al. | 420/83 |
| 2011/0094699 | A1* | 4/2011 | Miyazaki et al. | 164/57.1 |

FOREIGN PATENT DOCUMENTS

| | | | |
|---|---|---|---|
| DE | 2747660 | A1 | 6/1978 |
| EP | 0 709 470 | A1 | 5/1996 |
| JP | 52-129612 | | 10/1977 |
| JP | 53-66816 | | 6/1978 |
| JP | 61-231120 | A | 10/1986 |
| JP | 02-232319 | A | 9/1990 |
| JP | 03-126845 | A | 5/1991 |
| JP | 04-236719 | A | 8/1992 |
| JP | 05-140648 | A | 6/1993 |
| JP | 05-214444 | A | 8/1993 |
| JP | 07-041858 | A | 2/1995 |
| JP | 07-228953 | A | 8/1995 |
| JP | 08-088114 | A | 4/1996 |
| JP | 08-104923 | A | 4/1996 |
| JP | 2001-172718 | A | 6/2001 |
| JP | 2001-172753 | A | 6/2001 |

(Continued)

OTHER PUBLICATIONS

International Preliminary Report on Patentability (Forms PCT/IB/338, PCT/IB/373 and PCT/ISA/237) dated Mar. 21, 2013.

(Continued)

*Primary Examiner* — Jimmy T Nguyen
*Assistant Examiner* — Gregory Swiatocha
(74) *Attorney, Agent, or Firm* — Birch, Stewart, Kolasch & Birch, LLP

(57) ABSTRACT

A steel having a predetermined composition is hot-rolled so as to form a steel strip, the steel strip is subjected to first cold-rolling, the steel strip is subjected to intermediate annealing, the steel strip is subjected to second cold-rolling, and the steel strip is subjected to finish annealing. A finish temperature in the hot-rolling is 900° C. or less, annealing is not performed between the hot-rolling and the first cold-rolling, and a rolling reduction in the second cold-rolling is not less than 40% nor more than 85%.

9 Claims, No Drawings

(56) References Cited

FOREIGN PATENT DOCUMENTS

| | | | |
|---|---|---|---|
| JP | 2001-279327 | A | 10/2001 |
| JP | 2002-080948 | A | 3/2002 |
| JP | 2004-197217 | A | 7/2004 |
| JP | 2006-124809 | A | 5/2006 |

OTHER PUBLICATIONS

International Search Report for PCT/JP2011/067409 dated Sep. 27, 2011.
Extended European Search Report for European Application No. 11814559.8, dated Nov. 2, 2016.

* cited by examiner

MANUFACTURING METHOD OF NON-ORIENTED ELECTRICAL STEEL SHEET

TECHNICAL FIELD

The present invention relates to a manufacturing method of a non-oriented electrical steel sheet suitable for an iron core of an electric equipment.

BACKGROUND ART

In recent years, in fields of rotary machines, medium or small sized transformers, electrical components and the like, which use non-oriented electrical steel sheets as materials of their iron cores, a demand for realization of high-efficiency and miniaturization is increasing more and more, in the movement of global environmental conservation typified by the worldwide power and energy saving and $CO_2$ reduction and the like. Under such a social environment, an improvement in performance of the non-oriented electrical steel sheet is of course a pressing issue.

Further, according to the usage, favorable magnetic properties in a rolling direction are sometimes required for a non-oriented electrical steel sheet. For example, a non-oriented electrical steel sheet used for a divided iron core among iron cores of rotary machines, and a non-oriented electrical steel sheet used for iron cores of medium or small sized transformers, are sometimes required to improve magnetic properties in a rolling direction. In these iron cores, magnetic fluxes mainly flow in orthogonal two directions. Further, it is often the case that the rolling direction of the non-oriented electrical steel sheet is set to one direction, out of these two directions, in which an influence of the flow of the magnetic flux is particularly large.

Accordingly, various techniques have been conventionally proposed for the purpose of improving the magnetic properties of the non-oriented electrical steel sheet.

For example, a technique of increasing contents of Si and Al for the purpose of reducing an iron loss has been proposed. For instance, Patent Literature 1 describes a non-oriented electrical steel sheet in which an Al content is increased while keeping a relatively low Si content for the purpose of improving workability during performing cold-rolling. A technique in which not only the increase in contents of Si and/or Al and the like but also the reduction in contents of C, S, N and the like is realized, has also been proposed. Techniques of reducing an iron loss by making impurities harmless through chemical treatment such as an addition of Ca (Patent Literature 2), and an addition of REM (Patent Literature 3), have also been proposed. Further, Patent Literature 4 describes a technique regarding a condition of finish annealing.

For example, a technique regarding an improvement in magnetic flux density has also been proposed. For instance, Patent Literature 5 describes a technique regarding a condition of hot-rolled sheet annealing and a condition of cold-rolling. Further, Patent Literature 6 describes a technique regarding an addition of alloying elements of Sn, Cu and the like.

However, with the conventional techniques, it is difficult to sufficiently improve the magnetic properties in the rolling direction of the non-oriented electrical steel sheet. Further, with the technique in which the contents of Si and Al are increased for the purpose of reducing the iron loss, a saturation magnetic flux density becomes low. In particular, Al easily reduces the saturation magnetic flux density, when compared to Si, so that with the technique described in Patent Literature 1, the saturation magnetic flux density becomes extremely low. Such a technique in which the saturation magnetic flux density becomes low, is absolutely inappropriate for the miniaturization of electric equipments.

CITATION LIST

Patent Literature

Patent Literature 1: Japanese Laid-open Patent Publication No. 07-228953

Patent Literature 2: Japanese Laid-open Patent Publication No. 03-126845

Patent Literature 3: Japanese Laid-open Patent Publication No. 2006-124809

Patent Literature 4: Japanese Laid-open Patent Publication No. 61-231120

Patent Literature 5: Japanese Laid-open Patent Publication No. 2004-197217

Patent Literature 6: Japanese Laid-open Patent Publication No. 05-140648

Patent Literature 7: Japanese Laid-open Patent Publication No. 52-129612

Patent Literature 8: Japanese Laid-open Patent Publication No. 53-66816

Patent Literature 9: Japanese Laid-open Patent Publication No. 2001-172718

SUMMARY OF INVENTION

Technical Problem

The present invention has an object to provide a manufacturing method of a non-oriented electrical steel sheet capable of improving magnetic properties in a rolling direction.

Solution to Problem

The present inventors repeatedly conducted earnest studies from a point of view in which magnetic properties in a rolling direction in a non-oriented electrical steel sheet are improved by changing conditions of contents of respective components, treatment before cold-rolling, the number of times of the cold-rolling, a rolling reduction in the cold-rolling and the like.

As a result, although details will be described later, the present inventors found out that it is possible to obtain an effect of significantly improving the magnetic properties in the rolling direction, by providing appropriate contents of Si, Al, Mn and the like, an appropriate finish temperature in hot-rolling, an appropriate number of times of cold-rolling, and an appropriate rolling reduction in the second cold-rolling. Further, the present inventors came to the following manufacturing method of a non-oriented electrical steel sheet.

(1) A manufacturing method of a non-oriented electrical steel sheet, including:

performing hot-rolling of a steel material so as to form a steel strip, the steel material containing, in mass %:

Si: not less than 0.1% nor more than 4.0%;

Al: not less than 0.1% nor more than 3.0%; and

Mn: not less than 0.1% nor more than 2.0%;

a C content being 0.003% or less, and a balance being composed of Fe and inevitable impurity elements;

next, performing first cold-rolling of the steel strip;

next, performing intermediate annealing of the steel strip;

next, performing second cold-rolling of the steel strip; and next, performing finish annealing of the steel strip, wherein a finish temperature in the hot-rolling is 900° C. or less, the first cold-rolling is started without performing annealing after the hot-rolling; and a rolling reduction in the second cold-rolling is not less than 40% nor more than 85%.

(2) The manufacturing method of a non-oriented electrical steel sheet according to (1), wherein the steel material contains, in mass %, one or two selected from a group consisting of Sn: not less than 0.02% nor more than 0.40% and Cu: not less than 0.1% nor more than 1.0%.

(3) The manufacturing method of a non-oriented electrical steel sheet according to (1) or (2), wherein the steel material contains, in mass %, P: 0.15% or less.

(4) The manufacturing method of a non-oriented electrical steel sheet according to any one of (1) to (3), wherein the steel material contains, in mass %, Cr: not less than 0.2% nor more than 10.0%.

Advantageous Effects of Invention

According to the present invention, conditions in a process particularly from hot-rolling to cold-rolling are appropriately specified, so that it is possible to improve magnetic properties in a rolling direction.

DESCRIPTION OF EMBODIMENTS

Hereinafter, an embodiment of the present invention will be described in detail. In the present embodiment, a steel material (slab) having a predetermined composition is hot-rolled so as to form a steel strip, and cold-rolling of the steel strip is then performed twice with intermediate annealing therebetween. Thereafter, the steel strip is subjected to finish annealing. Moreover, a finish temperature in the hot-rolling, namely, a temperature in the finish rolling is 900° C. or less, and the first cold-rolling is started without performing annealing after the hot-rolling. In other words, the first cold-rolling is started while maintaining a metallic structure of the steel strip at the end of the hot-rolling. Further, a rolling reduction in the second cold-rolling is not less than 40% nor more than 85%.

Next, a composition of a steel material used in the present embodiment will be described. Hereinafter, "%" being a unit of content means "mass %". The present embodiment uses, for example, a steel containing Si: not less than 0.1% nor more than 4.0%, Al: not less than 0.1% nor more than 3.0%, and Mn: not less than 0.1% nor more than 2.0%, a C content of the steel being 0.003% or less, and a balance of the steel being composed of Fe and inevitable impurity elements. The steel may also contain one or two of Sn: not less than 0.02% nor more than 0.40% and Cu: not less than 0.1% nor more than 1.0%, the steel may also contain P: 0.15% or less, and the steel may also contain Cr: not less than 0.2% nor more than 10.0%. The steel material may be produced by making a steel melted in a converter, an electric furnace or the like to be subjected to continuous casting, or by making an ingot using the steel and making the ingot to be subjected to blooming.

Si has an effect of reducing an iron loss by increasing an electrical resistance of a non-oriented electrical steel sheet to reduce an eddy current loss. Further, Si also has an effect of improving punchability when the steel sheet is processed into a shape of iron core or the like by increasing a yield ratio. When a Si content is less than 0.1%, these effects are insufficient. On the other hand, when the Si content exceeds 4.0%, a magnetic flux density of the non-oriented electrical steel sheet is lowered. Besides, a hardness is excessively high, so that the punchability is lowered and the workability during the cold-rolling and the like is lowered. Further, this also leads to an increase in cost. Therefore, the Si content is not less than 0.1% nor more than 4.0%. Moreover, in order to obtain better magnetic properties, the Si content is preferably 2.0% or more.

Al, similar to Si, has an effect of reducing the iron loss by increasing the electrical resistance of the non-oriented electrical steel sheet to reduce the eddy current loss. Moreover, Al also has an effect of increasing a ratio of a magnetic flux density B50 to a saturation magnetic flux density Bs (B50/Bs) to improve a magnetic flux density. When an Al content is less than 0.1%, these effects are insufficient. On the other hand, when the Al content exceeds 3.0%, the saturation magnetic flux density itself is lowered, resulting in that the magnetic flux density is lowered. Further, when compared to Si, Al is difficult to cause an increase in hardness, but, when the Al content exceeds 3.0%, the yield ratio is decreased to lower the punchability. Therefore, the Al content is not less than 0.1% nor more than 3.0%. Further, in order to secure a high saturation magnetic flux density and the like, the Al content is preferably 2.5% or less. Here, the magnetic flux density B50 is a magnetic flux density under a condition where a frequency is 50 Hz, and the maximum magnetizing force is 5000 A/m.

Mn has an effect of reducing the iron loss by increasing the electrical resistance of the non-oriented electrical steel sheet to reduce the eddy current loss. Moreover, Mn also has an effect of developing {110}<001> orientation, which is desirable for the improvement in magnetic properties in the rolling direction, by improving a primary recrystallization structure. Furthermore, Mn suppresses a precipitation of fine sulfide (MnS or the like, for example), which inhibits the growth of crystal grains. When a Mn content is less than 0.1%, these effects are insufficient. On the other hand, when the Mn content exceeds 2.0%, it is difficult for crystal grains to grow during the intermediate annealing, resulting in that the iron loss is increased. Therefore, the Mn content is not less than 0.1% nor more than 2.0%. Further, in order to further reduce the iron loss, the Mn content is preferably less than 1.0%.

C has an effect of increasing the iron loss, and it may be also a cause of magnetic aging. Further, when C is contained in a steel strip during cold-rolling at room temperature, the development of the {110}<001> orientation, which is desirable for the improvement in the magnetic properties in the rolling direction, is sometimes suppressed. These phenomena are significant when a C content exceeds 0.003%. Therefore, the C content is 0.003% or less.

Sn has an effect of developing the {110}<001> orientation, which is desirable for the improvement in the magnetic properties in the rolling direction, by improving the primary recrystallization structure, and it also has an effect of controlling a {111}<112> orientation and the like, which are undesirable for the improvement in the magnetic properties. Moreover, Sn has an effect of suppressing oxidation and nitriding on a surface of the steel strip during the intermediate annealing, and it also has an effect of adjusting growth of crystal grains. When a Sn content is less than 0.02%, these effects are insufficient. On the other hand, when the Sn content exceeds 0.40%, these effects saturate and, on the contrary, the growth of crystal grains during the intermediate annealing is sometimes suppressed. Therefore, the Sn content is preferably not less than 0.02% nor more than 0.40%.

Cu, similar to Sn, has an effect of developing the {110}<001> orientation, which is desirable for the improvement in the magnetic properties in the rolling direction, by improving the primary recrystallization structure. When a Cu content is less than 0.1%, this effect is insufficient. On the other hand, when the Cu content exceeds 1.0%, a hot embrittlement is caused, resulting in that the workability in the hot-rolling is lowered. Therefore, the Cu content is preferably not less than 0.1% nor more than 1.0%.

P has an effect of increasing the yield ratio to improve the punchability. However, when a P content exceeds 0.15%, the hardness is increased too much, and the embrittlement is caused. As a result, the workability in the manufacturing process of the non-oriented electrical steel sheet is lowered, and the workability in a customer, namely, in a user of the non-oriented electrical steel sheet is lowered. Therefore, the P content is preferably 0.15% or less.

Cr has an effect of reducing the iron loss such as a high-frequency iron loss by increasing the electrical resistance of the non-oriented electrical steel sheet to reduce the eddy current loss. The reduction in the high-frequency iron loss is suitable for enabling high-speed rotation of a rotary machine. By enabling the high-speed rotation of the rotary machine, it is possible to deal with the demand for the realization of miniaturization and high-efficiency of the rotary machine. Moreover, Cr also has an effect of suppressing a stress sensitivity. By suppressing the stress sensitivity, a variation in properties caused by a stress during processing such as punching, and a variation in properties caused by a stress variation during the high-speed rotation are reduced. When a Cr content is less than 0.2%, these effects are insufficient. On the other hand, when the Cr content exceeds 10.0%, the magnetic flux density is lowered and the cost is increased. Therefore, the Cr content is preferably not less than 0.2% nor more than 10.0%.

The components of the steel except the above-described components may be Fe and inevitable impurities, for example. Incidentally, when the Si content (%), the Al content (%) and the Mn content (%) are represented by [Si], [Al] and [Mn], respectively, a value obtained through an expression "[Si]+[Al]+[Mn]/2" is preferably 4.5% or less. This is for securing the workability in the processing of cold-rolling and the like.

Next, explanation will be made on experiments by which it is concluded that conditions for the hot-rolling, the cold-rolling and the like are defined as described above.

The present inventors first produced steel slabs each containing components presented in Table 1 and a balance composed of Fe and inevitable impurities. Then, hot-rolling of each steel slab was conducted so as to produce a steel strip (hot-rolled sheet), and cold-rolling was performed twice. At this time, the first cold-rolling was started without performing hot-rolled sheet annealing after the hot-rolling, and intermediate annealing was conducted at 1000° C. for 1 minute between the two times of cold-rolling. A thickness of each steel strip after the cold-rolling (cold-rolled sheet) was set to 0.35 mm. Finish temperatures in the hot-rolling, thicknesses of the hot-rolled sheets, thicknesses of the steel strips after the first cold-rolling, and rolling reductions in the second cold-rolling are presented in Table 2. After performing the second cold-rolling, finish annealing was performed at 950° C. for 30 seconds. As is apparent from table 2, a rolling reduction in the first cold-rolling was set to 31.4% to 36.4%. Then, a sample was taken from each steel strip after the finish annealing, and as magnetic properties thereof, a magnetic flux density B50 and an iron loss W15/50 were measured. Here, the iron loss W15/50 is an iron loss under a condition where a frequency is 50 Hz, and the maximum magnetic flux density is 1.5 T. Results of these are also presented in Table 2.

TABLE 1

| COMPONENT OF STEEL SLAB (MASS %) | | | | |
|---|---|---|---|---|
| C | Si | Al | Mn | P |
| 0.0019 | 2.91 | 0.48 | 0.27 | 0.022 |

TABLE 2

| CONDITION No. | FINISH TEMPERATURE IN HOT-ROLLING (° C.) | THICKNESS OF HOT-ROLLED SHEET (mm) | THICKNESS AFTER FIRST COLD-ROLLING (mm) | ROLLING REDUCTION IN SECOND COLD-ROLLING (%) | MAGNETIC FLUX DENSITY IN ROLLING DIRECTION B50 (T) | IRON ROSS IN ROLLING DIRECTION W15/50 (W/kg) |
|---|---|---|---|---|---|---|
| 1 | 851 | 0.8 | 0.55 | 36.4 | 1.69 | 2.23 |
| 2 | 856 | 1.1 | 0.70 | 50.0 | 1.74 | 1.91 |
| 3 | 957 | 1.5 | 1.00 | 65.0 | 1.72 | 2.14 |
| 4 | 855 | 1.5 | 1.00 | 65.0 | 1.75 | 1.83 |
| 5 | 842 | 4.0 | 2.70 | 87.0 | 1.69 | 2.27 |

It can be understood that in the condition where the hot-rolled sheet annealing is not performed, the magnetic properties in the rolling direction of the non-oriented electrical steel sheet can be significantly improved by appropriately combining the finish temperature in the hot-rolling and the rolling reduction in the second cold-rolling, as seen from Table 2. In other words, it can be said that when the finish temperature in the hot-rolling is 900° C. or less, and the rolling reduction in the second cold-rolling is not less than 40% nor more than 85%, it is possible to obtain extremely good magnetic properties in the rolling direction.

In a condition No. 1, the rolling reduction in the second cold-, in a condition No. 5, the rolling reduction in the second cold-rolling was set to 87.0%, being over 85%. For this reason, in the conditions No. 1 and No. 5, the magnetic properties in the rolling direction were inferior to those in conditions No. 2 and No. 4.

Further, in a condition No. 3, the rolling reduction in the second cold-rolling was set to 65.0%, but, the finish temperature in the hot-rolling was set to 957° C., being over 950° C. For this reason, the magnetic properties in the rolling direction were inferior to those in the conditions No. 2 and No. 4.

As described above, in the condition where the hot-rolled sheet annealing is not performed, by setting the finish temperature in the hot-rolling to 900° C. or less, and by setting the rolling reduction in the second cold-rolling to not less than 40% nor more than 85%, it is possible to obtain extremely good magnetic properties in the rolling direction. The following can be considered as the reason thereof. To start the first cold-rolling with the finish temperature in the hot-rolling being 900° C. or less and without performing the hot-rolled sheet annealing is the same as to start the first cold-rolling while maintaining a metallic structure of the steel strip at the end of the finish rolling. Therefore, a high proportion of non-recrystallized rolled texture having the {110}<001> orientation is maintained. When the intermediate annealing is performed under the state of maintaining the high proportion of rolled texture, and then the second cold-rolling is conducted at the rolling reduction of not less than 40% nor more than 85%, crystal grains in the {110}<001> orientation grow during recrystallization caused by the finish annealing performed after the cold-rolling. As described above, the crystal grains in the {110}<001> orientation contribute to the improvement in the magnetic properties in the rolling direction. Incidentally, in order to more securely maintain high proportion of non-recrystallized rolled texture, it is preferable to set the finish temperature to 860° C. or less.

Further, the effect obtained by setting the finish temperature in the hot-rolling to 900° C. or less, starting the first cold-rolling without performing the hot-rolled sheet annealing, and setting the rolling reduction in the second cold-rolling to not less than 40% nor more than 85% is significant when the Si content is 2.0% or more, which is a favorable content. This is because, when the Si content is 2.0% or more, a proportion of non-recrystallized rolled texture is increased, and when the recrystallization is once started, an activation energy of the growth of crystal grains is increased, resulting in that the growth of crystal grains in the {110}<001> orientation is significantly facilitated.

Besides, regarding the Young's modulus in each crystal orientation of the non-oriented electrical steel sheet, the Young's modulus in the {110}<001> orientation is smaller than the Young's modulus in the crystal orientation such as the {111}<112> orientation, which is undesirable for the improvement in the magnetic properties. The texture of the non-oriented electrical steel sheet manufactured by the present embodiment has a significantly developed {110}<001> orientation. Therefore, the Young's modulus of the non-oriented electrical steel sheet manufactured by the present embodiment is relatively low. When the Young's modulus is low, even if a compressive strain is applied in a shrink fitting or the like when producing an iron core from the non-oriented electrical steel sheet, a compressive stress generated due to the compressive strain is low. Therefore, according to the present embodiment, it is also possible to reduce the deterioration of magnetic properties due to the compressive stress. In other words, according to the present embodiment, it is also possible to achieve an effect such that, in addition to the realization of the improvement in the magnetic properties in the rolling direction, the reduction in the deterioration of magnetic properties when the compressive strain is applied is also realized by lowering the Young's modulus.

Incidentally, when the rolling reduction in the second cold-rolling is less than 40%, a proportion of random orientations increases. Further, when the rolling reduction in the second cold-rolling exceeds 85%, a proportion of not the {110}<001> orientation but the {111}<112> orientation increases. For this reason, in these cases, the magnetic properties in the rolling direction do not improve sufficiently.

Further, the non-oriented electrical steel sheet manufactured through the method as above is a suitable one as a material of iron cores of various electric equipments. In particular, the non-oriented electrical steel sheet is a desirable one as a material of a divided iron core among iron cores of rotary machines, and further, it is a desirable one also as a material of iron cores of middle and small sized transformers. For this reason, it is possible to realize the high-efficiency and the miniaturization in the fields of rotary machines, medium and small sized transformers, electrical components and the like which use the non-oriented electrical steel sheets as materials of their iron cores.

EXAMPLE

Next, experiments conducted by the present inventors will be described. Conditions and so on in these experiments are examples employed to verify practicality and effects of the present invention, and the present invention is not limited to these examples.

Example 1

First, steel slabs each containing components presented in Table 3 and a balance composed of Fe and inevitable impurities were produced. Then, hot-rolling of each steel slab was conducted to produce a steel strip (hot-rolled sheet), and cold-rolling was performed twice. At this time, the first cold-rolling was started without performing hot-rolled sheet annealing after the hot-rolling, and intermediate annealing was conducted at 950° C. for 2 minutes between the two times of the cold-rolling. A thickness of each steel strip after the cold-rolling was set to 0.35 mm. Finish temperatures in the hot-rolling, thicknesses of the hot-rolled sheets, thicknesses of the steel strips after performing the first cold-rolling, and rolling reductions in the second cold-rolling are presented in Table 4. After performing the second cold-rolling, finish annealing was performed at 970° C. for 40 seconds. As is apparent from table 4, a rolling reduction in the first cold-rolling was set to approximately 40%. Further, a sample was taken from each steel strip after the finish annealing, and as magnetic properties thereof, a magnetic flux density B50 and an iron loss W10/400 were measured. The iron loss W10/400 is an iron loss under a condition where a frequency is 400 Hz, and the maximum magnetic flux density is 1.0 T. Results of these are also presented in Table 4.

TABLE 3

| CONDITION | COMPONENT OF STEEL SLAB (MASS %) | | | | | |
|---|---|---|---|---|---|---|
| No. | C | Si | Al | Mn | Sn | Cu |
| 11 | 0.0022 | 2.69 | 1.01 | 0.23 | — | — |
| 12 | 0.0020 | 2.65 | 1.05 | 0.21 | 0.07 | — |
| 13 | 0.0021 | 2.71 | 0.98 | 0.25 | 0.08 | — |
| 14 | 0.0021 | 2.67 | 0.97 | 0.23 | — | 0.34 |
| 15 | 0.0023 | 2.68 | 1.04 | 0.26 | 0.07 | — |

TABLE 4

| CONDITION No. | FINISH TEMPERATURE IN HOT-ROLLING (° C.) | THICKNESS OF HOT-ROLLED SHEET (mm) | THICKNESS AFTER FIRST COLD-ROLLING (mm) | ROLLDING REDUCTION IN SECOND COLD-ROLLING (%) | MAGNETIC FLUX DENSITY IN ROLLING DIRECTION B50 (T) | IRON ROSS IN ROLLING DIRECTION W10/400 (W/kg) | REMARKS |
|---|---|---|---|---|---|---|---|
| 11 | 846 | 1.8 | 1.1 | 68.2 | 1.76 | 13.5 | EXAMPLE |
| 12 | 841 | 0.9 | 0.5 | 30.0 | 1.69 | 15.6 | COMPARATIVE EXAMPLE |
| 13 | 839 | 1.8 | 1.1 | 68.2 | 1.77 | 13.1 | EXAMPLE |
| 14 | 844 | 1.8 | 1.1 | 68.2 | 1.77 | 13.2 | EXAMPLE |
| 15 | 851 | 4.2 | 2.6 | 86.5 | 1.70 | 15.7 | COMPARATIVE EXAMPLE |

In a condition No. 12, the rolling reduction in the second cold-rolling was set to 30.0%, being less than 40%. Further, in a condition No. 15, the rolling reduction in the second cold-rolling was set to 86.5%, being over 85%. For this reason, in the conditions No. 12 and No. 15, the magnetic properties in the rolling direction were inferior to those in conditions No. 11, No. 13 and No. 14.

Further, in the condition No. 13, in which Sn was contained, and the condition No. 14, in which Cu was contained, the magnetic properties in the rolling direction were better than those in the condition No. 11, in which Sn and Cu were not contained. As seen from the results, it can be understood that when Sn or Cu is contained, the magnetic properties in the rolling direction are further improved. Moreover, as is apparent from Table 4, it can be understood that, according to the examples of the present invention, it is possible to manufacture the non-oriented electrical steel sheets excellent in magnetic properties in the rolling direction.

Example 2

First, steel slabs each containing components presented in Table 5 and a balance composed of Fe and inevitable impurities were produced. Then, hot-rolling of each steel slab was conducted to produce a steel strip (hot-rolled sheet) having a thickness of 2.3 nm, and cold-rolling was performed twice. At this time, although the first cold-rolling was started without performing hot-rolled sheet annealing after the hot-rolling in conditions No. 21, No. 23 and No. 24, the first cold-rolling was conducted after performing the hot-rolled sheet annealing at 950° C. for 2 minutes in a condition No. 22. Further, intermediate annealing was conducted at 980° C. for 1 minute between the two times of cold-rolling. Finish temperatures in the hot-rolling are presented in Table 6. A thickness of each steel strip after the first cold-rolling was set to 0.8 mm, and a rolling reduction in the second cold-rolling was set to 62.5%, to thereby set a thickness of each steel strip after the second cold-rolling to 0.30 mm. After performing the second cold-rolling, finish annealing was performed at 950° C. for 20 seconds. Further, a sample was taken from each steel strip after the finish annealing, and as magnetic properties thereof, the magnetic flux density B50 and the iron loss W10/400 were measured. Results of these are presented in Table 6.

TABLE 5

| CONDITION | COMPONENT OF STEEL SLAB (MASS %) | | | | |
|---|---|---|---|---|---|
| No. | C | Si | Al | Mn | Cr |
| 21 | 0.0017 | 3.05 | 1.18 | 0.35 | — |
| 22 | 0.0016 | 3.01 | 1.20 | 0.33 | — |
| 23 | 0.0016 | 3.07 | 1.17 | 0.36 | 2.35 |
| 24 | 0.0019 | 3.04 | 1.22 | 0.39 | 6.47 |

TABLE 6

| CONDITION No. | FINISH TEMPERATURE IN HOT-ROLLING (° C.) | HOT-ROLLED SHEET ANNEALING | MAGNETIC FLUX DENSITY IN ROLLING DIRECTION B50 (T) | IRON ROSS IN ROLLING DIRECTION W10/400 (W/kg) | REMARKS |
|---|---|---|---|---|---|
| 21 | 836 | NONE | 1.75 | 12.8 | EXAMPLE |
| 22 | 839 | 950° C. × 2 MIN. | 1.72 | 14.5 | COMPARATIVE EXAMPLE |
| 23 | 832 | NONE | 1.73 | 11.4 | EXAMPLE |
| 24 | 829 | NONE | 1.67 | 10.6 | EXAMPLE |

When comparing the condition No. 21 and the condition No. 22, although they have similar compositions of the non-oriented electrical steel sheets, significantly excellent magnetic properties in the rolling direction were obtained in the condition No. 21. This is because, although the hot-rolled sheet annealing was not conducted in the condition No. 21, the hot-rolled sheet annealing was conducted in the condition No. 22.

Further, in the conditions No. 23 and No. 24, in which Cr was contained, the iron loss in the rolling direction was significantly low, compared to that in the condition No. 21, in which Cr was not contained. As seen from the results, it can be understood that when Cr is contained, the iron loss in the rolling direction is further suppressed. Moreover, as is apparent from Table 6, it can be understood that, according to the examples of the present invention, it is possible to manufacture the non-oriented electrical steel sheets excellent in magnetic properties in the rolling direction.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

INDUSTRIAL APPLICABILITY

The present invention may be utilized in an industry of manufacturing electrical steel sheets and an industry of utilizing electrical steel sheets, for example. In short, the present invention may also be utilized in an industry related to electric equipments using electrical steel sheets. Further, the present invention may contribute to technical innovations of these industries.

The invention claimed is:

1. A manufacturing method of a non-oriented electrical steel sheet, comprising:

performing hot-rolling of a steel material so as to form a steel strip, the steel material containing, in mass %:

Si: not less than 0.1% nor more than 4.0%;

Al: not less than 0.1% nor more than 3.0%; and

Mn: not less than 0.1% nor more than 2.0%;

a C content being 0.003% or less, and a balance being composed of Fe and inevitable impurity elements;

next, performing first cold-rolling of the steel strip, wherein a rolling reduction in the first cold-rolling is not less than 31.4% nor more than approximately 40%;

next, performing intermediate annealing of the steel strip;

next, performing second cold-rolling of the steel strip; and next, performing finish annealing of the steel strip at a temperature of not less than 950° C. nor more than 970° C. so as to cause recrystallization in which crystal grains in {110}<001> orientation grow, wherein a finish temperature in the hot-rolling is 900° C. or less, the first cold-rolling is started without performing annealing after the hot-rolling; and a rolling reduction in the second cold-rolling is not less than 40% nor more than 85%.

2. The manufacturing method of a non-oriented electrical steel sheet according to claim 1, wherein the steel material contains, in mass %, one or two selected from a group consisting of Sn: not less than 0.02% nor more than 0.40% and Cu: not less than 0.1% nor more than 1.0%.

3. The manufacturing method of a non-oriented electrical steel sheet according to claim 1, wherein the steel material contains, in mass %, P: 0.15% or less.

4. The manufacturing method of a non-oriented electrical steel sheet according to claim 2, wherein the steel material contains, in mass %, P: 0.15% or less.

5. The manufacturing method of a non-oriented electrical steel sheet according to claim 1, wherein the steel material contains, in mass %, Cr: not less than 0.2% nor more than 10.0%.

6. The manufacturing method of a non-oriented electrical steel sheet according to claim 2, wherein the steel material contains, in mass %, Cr: not less than 0.2% nor more than 10.0%.

7. The manufacturing method of a non-oriented electrical steel sheet according to claim 3, wherein the steel material contains, in mass %, Cr: not less than 0.2% nor more than 10.0%.

8. The manufacturing method of a non-oriented electrical steel sheet according to claim 4, wherein the steel material contains, in mass %, Cr: not less than 0.2% nor more than 10.0%.

9. The manufacturing method of a non-oriented electrical steel sheet according to claim 1, wherein a rolling reduction in the first cold-rolling is not less than 31.4% nor more than 38.9%.

* * * * *